United States Patent [19]

Labbé et al.

[11] Patent Number: 4,614,459

[45] Date of Patent: Sep. 30, 1986

[54] FLOATING TUBE APPARATUS FOR PROVIDING A SEALED REVERSIBLE AND REMOTE-CONTROLLED CONNECTION BETWEEN DUCTS IN PARTICULAR UNDERWATER DUCTS

[75] Inventors: Roland Labbé, Sainte Luce sur Loire; Francis Rodriguez, Vertou, both of France

[73] Assignee: Alsthom-Atlantique, Paris, France

[21] Appl. No.: 758,628

[22] PCT Filed: Dec. 5, 1984

[86] PCT No.: PCT/FR84/00286

§ 371 Date: Jul. 18, 1985

§ 102(e) Date: Jul. 18, 1985

[87] PCT Pub. No.: WO85/02652

PCT Pub. Date: Jun. 20, 1985

[30] Foreign Application Priority Data

Dec. 7, 1983 [FR] France ..... 83 19569

[51] Int. Cl.[4] ..... F16L 1/04

[52] U.S. Cl. ..... 405/170; 285/24; 405/169

[58] Field of Search ..... 405/158, 169, 170, 190, 405/191; 166/341, 343, 344, 347; 285/18, 24, 27, 31

[56] References Cited

U.S. PATENT DOCUMENTS 3,658,366 4/1972 Welch et al. ..... 285/24
4,014,180 3/1977 Kelly et al. ..... 405/170
4,019,334 4/1977 Sinclair et al. ..... 405/169
4,251,167 2/1981 Nobileau et al. ..... 405/70

FOREIGN PATENT DOCUMENTS 2181705 12/1973 France .
2417001 9/1979 France .
2038973 7/1980 United Kingdom .

*Primary Examiner*—David H. Corbin
*Attorney, Agent, or Firm*—Sughrue, Mion, Zinn, Macpeak & Seas

[57] ABSTRACT

A floating tube apparatus (7) for providing a sealed, reversible and remote-controlled connection between ducts, in particular underwater ducts or difficultly accessible ducts, provided with complementary connectors to connectors (8, 9) carried by the floating tube at its ends. The apparatus comprises a positioning device (17, 21, 22, 23, 24) for positioning the floating tube (7) relative to a reference plane defined by a rectilinear rolling path of fixed structure (18). The positioning device includes a ball joint (23, 24) mounted on the middle of the tube (7) and three carriages mounted on one another in such a manner as to enable each to be displaced rectilinearly along a displacement axis which is perpendicular to the displacement axes of the other two, the transfer carriage (17) which carries the other two carriages moving along the rolling path under the action of jacks (31A, 31B), and the carriage (22) carried by the other two carriages itself carrying the ball joint, and consequently the tube. The apparatus is particularly intended for underwater oil exploitation.

10 Claims, 9 Drawing Figures

FLOATING TUBE APPARATUS FOR PROVIDING A SEALED REVERSIBLE AND REMOTE-CONTROLLED CONNECTION BETWEEN DUCTS IN PARTICULAR UNDERWATER DUCTS

FIELD OF THE INVENTION

The present invention relates to so-called floating tube connection apparatuses for providing sealed, reversible and remote-controlled connections between ducts which are difficultly accessible or are unaccessible in normal operation, e.g. underwater ducts.

BACKGROUND OF THE INVENTION

The remote-controlled connection of ducts is required, in particular when the ends to be connected are placed in zones which are difficult or impossible for access by man because of the risks encountered. This is particularly the case of underwater installations for producing oil in deep waters.

It is known that under such circumstances it is advantageous to dispose the equipments of such installations in independent modules which are connectable and which may be placed on the bottom and, where necessary, raised to the surface without requiring divers to be present at the bottom. It is then necessary to provide apparatus enabling firstly the establishment of connections between ducts to enable exploitation, and secondly enabling disconnections when it is necessary to raise one or other of the modules located at the bottom to the surface.

Thus, the applicants' French patent application No. 2,500,525 describes an exploitation module connection for modules such as wellhead modules, using ducts called gatherers by means of auxiliary modules. An auxiliary module may include, for example, valves for controlling the flow-rate of fluid, and in particular oil, through a gatherer, from or towards a wellhead module.

To this end, the auxiliary module likely to be raised or lowered in isolation includes a length of duct called a floating tube which serves to connect a wellhead module to a gatherer in order pass the above-mentioned fluids.

Naturally, the apparatus in accordance with the invention may be used without such a module and under different conditions of exploitation, in particular, it may be used without changing the main items which are mentioned in the present application, for example in installations which are dangerous to man because of the presence of intense radioactive radiation.

In order to facilitate understanding, reference is made in the following description to the connection conditions mentioned in French patent application No. 2,500,525, and in particular a connection is described between a duct having at least one end which is fixed or which is temporarily fixed to a gatherer whose end to be connected is located in a predetermined position prior to connection.

The duct and the gatherer have their respective end connectors aligned and facing each other and at a sufficient distance apart to enable an auxiliary module to be inserted therebeween, said auxiliary module carrying the floating tube with a complementary connector at each end thereof.

The gatherers terminate at determined positions on bases placed on the water bed, and the modules are placed in housings provided in the top portion of the bases.

Insofar as the modules are arranged to be positioned in their housings by remote-control from the surface and in particular where the auxiliary modules are arranged to be raised for replacement or for maintenance, it is necessary to leave room between each auxiliary module and the ends of the wellhead module and of the gatherer which it serves to interconnect in order to enable the auxiliary module to be displaced when it is disconnected from these two items.

Thus, during connection, it is necessary to displace the floating tube to connect one of its ends to the corresponding end of the gatherer which is then situated outside the auxiliary module and which is capable of a certain degree of movement. The floating tube is then displaced in the opposite direction pulling the gatherer with it so as to connect the other end of the floating tube to the corresponding end of the wellhead connection duct.

Preferably, the ends of the gatherer and of the connection duct are aligned, for example on a common horizontal axis to facilitate their interconnection by means of a floating tube.

In practice, it is difficult or impossible to correct offsets in level between the ends of the gatherer and the connection duct prior to their connection by the floating tube. Further, the meeting planes at the ends of the floating tube and the ends of the gatherer or the connection duct are not generally perfectly parallel as would be desirable for facilitating connection under remote control.

There is thus a grave risk of causing inacceptable deformation of the axis line of the internal channels in the assembly constituted by end-to-end connection of the gatherer, of the floating tube and of the wellhead connection duct after connection has taken place. This may be most inconvenient, in particular, when tools are required to pass inside the ducts and may jam at the deformations.

SUMMARY OF THE INVENTION

Consequently, the present invention thus proposes a floating tube apparatus for sealed, reversible and remote-controlled connection of ducts, in particular underwater or difficultly accessible ducts, provided with connectors which are complementary to connectors carried by the ends of the floating tube and which, prior to connection, have a position which at least approximately predetermined within a range of admissible tolerances so as to enable successive connection of one of the ducts having at least a connector which it displaceable in sealed manner by being locked to the corresponding complementary connector of the floating tube prior to being displaced longitudinally under remote-control, and then to the other duct by locking the connector of said other duct with the second connector carried by the floating tube after longitudinally displacing it in the opposite direction together with at least the first connected duct connector.

According to a characteristic of the invention, the said floating tube apparatus comprises a positioning device constituted by a ball joint which carries the floating tube in the middle and by three carriages mounted on one another and capable of rectilinear displacement with each carriage being displaced along an axis perpendicular to the axes of the other two carriages. The transfer carriage which carries the other two carriages being displaced under the action of at least one remote-controlled hydraulic jack along a rectilinear running path of a fixed frame serving as a reference plane for the positioning device, the carriage which is carried by the other two carriages itself carries the ball joint in such a manner as to enable the meeting planes of a pair of connectors to be put into parallel with each other prior to locking and to ensure continuous alignment of the internal channels of the ducts.

The invention, its characteristics and advantages are described in the following description given with reference to the figures mentioned below.

DESCRIPTION OF THE PREFERRED EMBODIMENT

Figure 1:
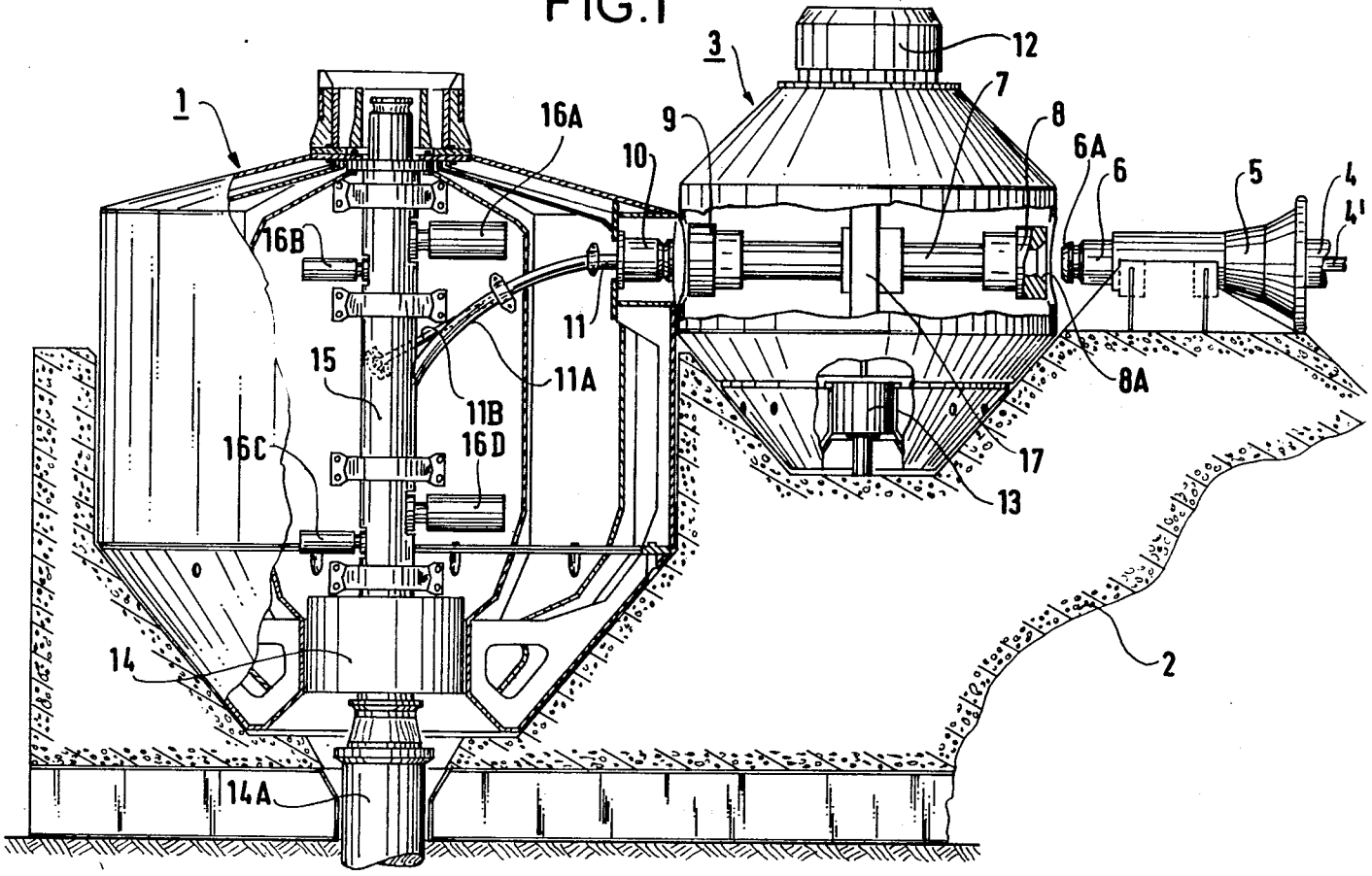
FIG. 1 is a vertical diagram partially in section of an example of an auxiliary module provided with a floating sleeve for connecting a gatherer to a connection duct of a specific module which is constituted in this case by a wellhead.

The assembly shown in FIG. 1 comprises an exploitation module 1, symbolized in this case by a wellhead module, which exploitation module is lodged in the top part of a base 2, in parallel with an auxiliary module 3, one of whose functions is to connect it to a gatherer 4 only one end of which is shown.

One of the ends of the gatherer 4 which is only sketched herein is lodged in a sleeve 5 having a horizontal axis which is fixed to the base 2. This end, which may move in limited manner along the axis of the sleeve is terminated by a connector 6 whose connection plane is placed with a degree of tolerance in a predetermined position prior to connection. In one embodiment, the gatherer 4 which is flexible is placed in a short and wide oblique rigid sheath 4' fixed to the sleeve 5 at one end and to the gatherer 4 at the other end. The dimensions of the sheet 4' relative to the gatherer 4 and its angle relative to the sleeve 5 allow for the gatherer to move sideways in the sheath and this possibility is taken advantage of to enable horizontal displacement of the end of the gatherer which carries the connector 6 towards the auxiliary module 3 against the resilient return force of the portion of the gatherer situated inside the sheath.

The auxiliary module 3 comprises a shell in which there is lodged, in particular, a floating tube 7 which is visible in FIG. 1. This floating tube is provided at one of its ends with a connector 8 which is complementary to the connector 6, and at its other end with a connector 9 which is complementary to a connector 10 carried by the exploitation module 1 at one end of a connection duct 11.

The various connectors 6, 8, 9, 10 are lockable to one another, for example of the type described in French patent application No. 2,500,525. They are also self-centering, with one of the connectors such as 6 or 10 having a chamfered cylindrical end such as 6A while the complementary connector 8 or 9 possesses a flared conical inlet, such as 8A.

The auxiliary whose shell conventionally encloses other components, for example valves not shown, is conventionally equipped with a service head 12 enabling it to be winched and an anchor device 13 at the bottom of the shell, it also comprises at least one remote-control connector (not shown) for control links which are also not shown here.

The connector 10 of the exploitation module 1 is positioned horizontally opposite the connector 6 with a degree of tolerance, it is placed at the end of the connection duct 11 and level with the side wall of the exploitation module.

The exploitation module 1, or more precisely the wellhead which is shown, comprises a connector 14 placed vertically at the bottom of the module for making a sealed connection with the top of tubing 14A which is located at the top of a borehole. The tubing 14A comprises a central channel for oil and a coaxial annular channel for service requirements. The connector 14 conventionally supplies a lateral whipstock 15 through which two separate conduits 11A and 11B leave laterally, one for the central channel and the other for the annular channel.

The conduits 11A and 11B which form a so-called two-channel connection duct end at the connector 10. The lateral whipstock 15 is conventionally located between two sets of two valves for which only the control jacks 16A, 16B, 16C and 16D are visible in FIG. 1.

Figure 2:
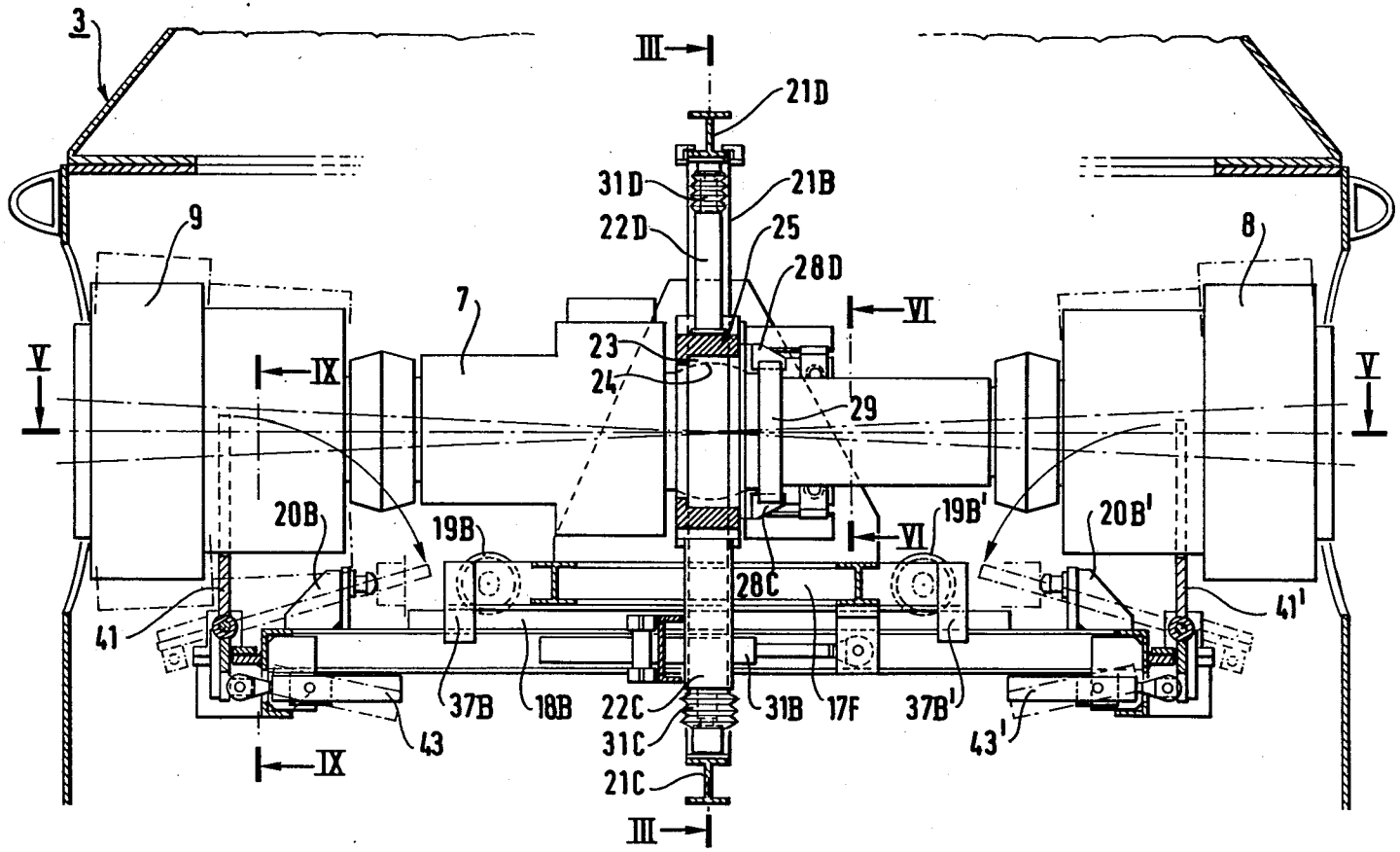
FIG. 2 is an elevation view, in section, along lines II—II through a positioning device for the floating tube in an auxiliary module and in accordance with the invention.
Figure 3:
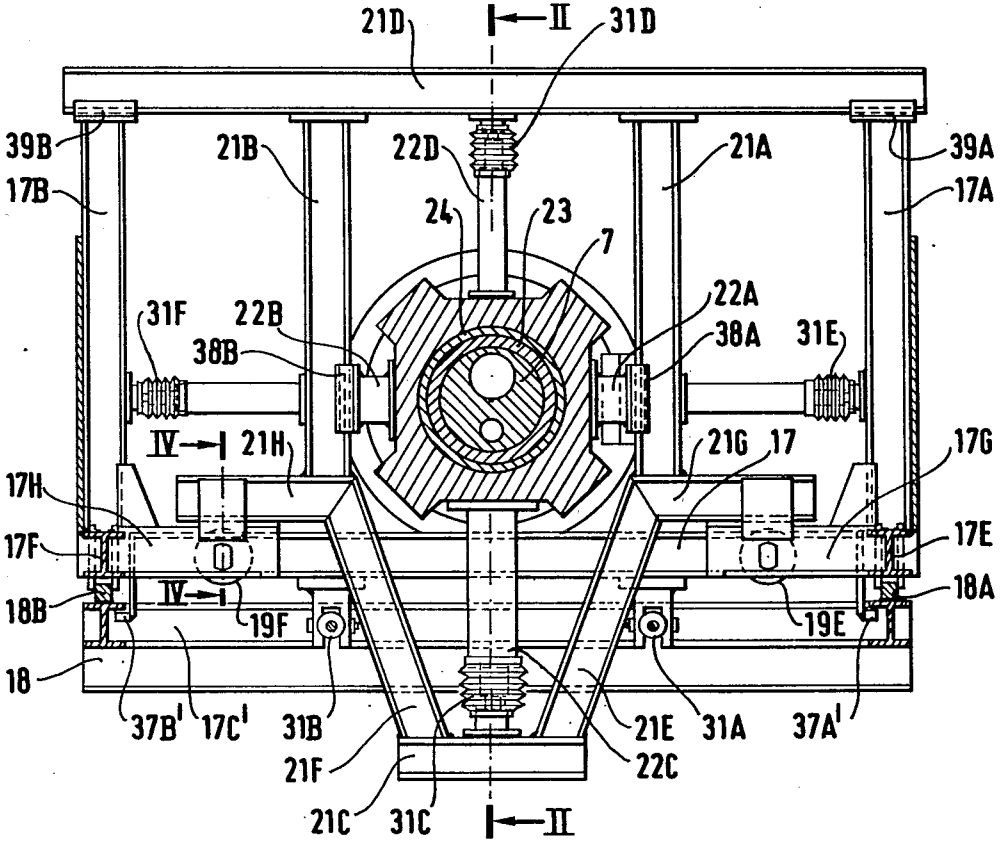
FIG. 3 is a sectional view, along lines on III—III of the device shown in FIG. 2.
Figure 5:
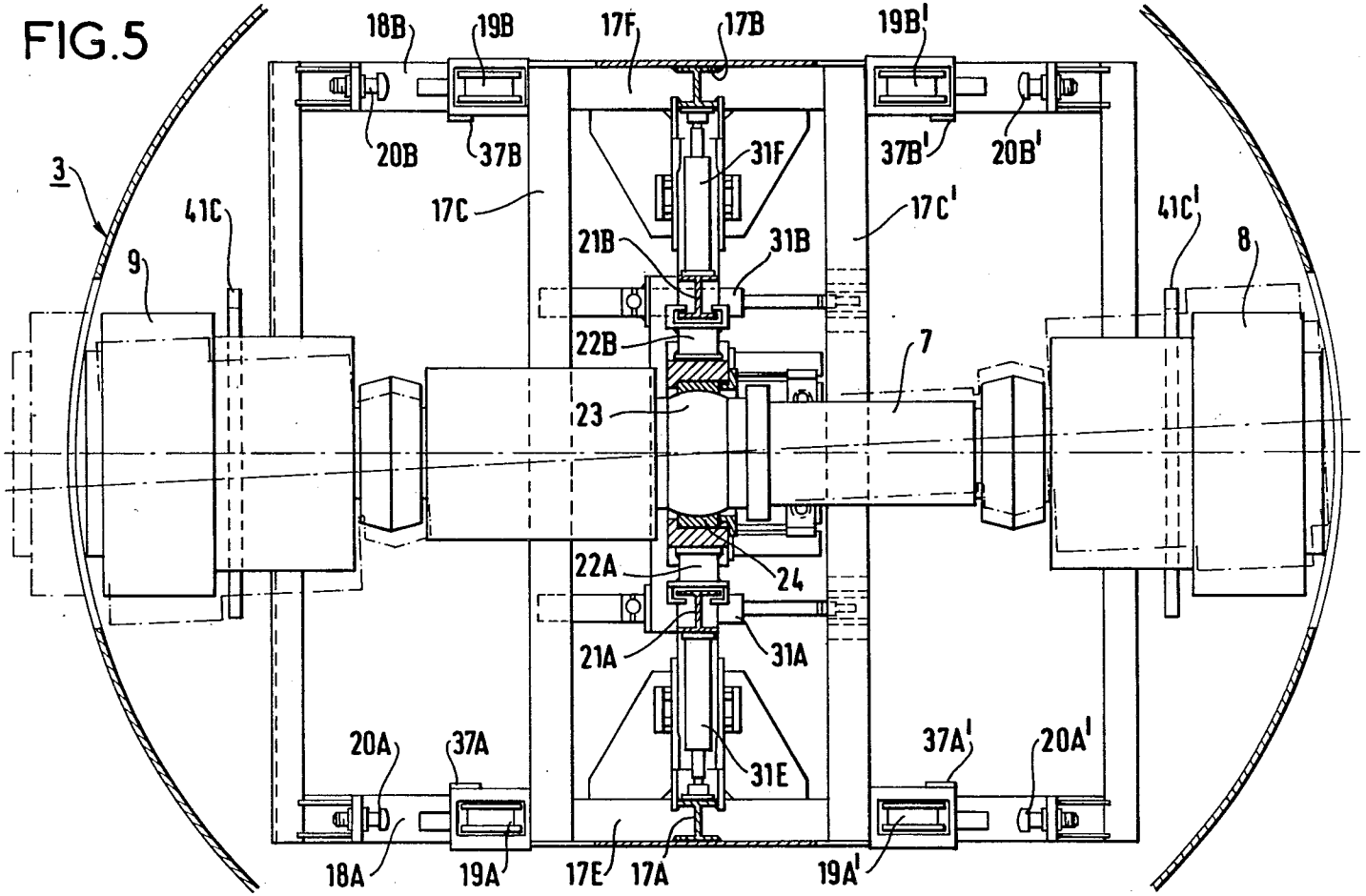
FIG. 5 is a plan view, in section, along lines V—V of the device shown in FIGS. 2 and 3.

FIGS. 2, 3 and 5 serve to define the positioning device for a floating connection tube apparatus in accordance with the invention, which apparatus may include, as in this case, a shell in which the positioning device for displacing the floating sleeve is placed in a determined manner, or else, for example, a mere base on which the positioning device is likewise placed in determined manner. In the example shown, the apparatus also includes in its shell other units (not shown) such as valves and it constitutes a self-contained auxiliary module capable of being winched in isolation.

In accordance with the invention the device for positioning the floating tube serves to displace the floating tube 7 triaxially relative to a fixed surface defined by a rigid frame, whereby the floating tube can be adapted to the various possible positions of gatherer connectors and of duct connectors over a predetermined range of tolerances.

These displacements along three axes are obtained by means of carriages and are combined with the possibility of oscillating the tube which is provided with a central ball joint for this purpose.

To begin with, a transfer carriage 17 is provided to displace the floating tube 7 along its longitudinal axis (FIG. 5).

In the embodiment shown, this transfer carriage 17 moves along a rectilinear running path defined by two parallel rails 18A and 18B of a rigid structure 18 which is fixed in the auxiliary module 3, or more precisely in the central portion of the shell of this module, in such a manner that the rails (and consequently the plane of displacement of the transfer carriage) are horizontal when the auxiliary module is in place in its housing in the base. When the transfer carriage 17 is half-way along the rails, the connectors 8 and 9 are lodged inside the shell in such a manner as to be protected against shocks during winching manoeuvres of the module.

The transfer carriage 17 is rectangular in shape and comprises four beams 17C, 17C', 17E and 17F and carries conventional wheels 19A, 19A4, 19B and 19B' so as to enable it to be displaced on the rails between end stops 20A, 20A', 20B and 20B' which are conventionally disposed at the ends of the rails 18A and 18B.

In the embodiment chosen, the wheels 19 are of the type having side cheeks for embracing the rail on which they run, and the carriage is held together with its wheels against the rails by four fixing tabs 37A, 37A', 37B and 37B' which are disposed at the ends of the carriage close to the wheels and which are inserted under an overhang from the rails 18A and 18B which are T-shaped or preferably I-shaped so as to prevent the transfer carriage 17 from becoming derailed even if it is lifted relative to the frame during manoeuvres.

The displacement of the transfer carriage along the rails 18A and 18B is conventionally remote-controlled, and the remote-control acts on at least one and preferably two hydraulic jacks 31A and 31B which are inserted between the frame and the carriage.

An intermediate carriage 21 is provided to displace the floating tube transversely relative to the axis of displacement of the transfer carriage 17, and its constitution is defined below (FIG. 3).

Finally, a carriage 22 carries the floating tube 7 and is provided to enable the floating tube to be displaced along a third displacement axis perpendicular to the longitudinal displacement axis and to the transversal displacement axis as defined above.

This carrying carriage 22 will also be defined below, and carries a spherical ball joint 23, 24 allowing the floating tube 7 to oscillate through a limited angle. The ball joint 23, 23 is preferably situated in the middle of the floating tube 7 in such a manner that its center corresponds with the center of gravity when immersed of the tube (FIG. 2). The ball joint 23, 24 includes a spherical portion 23 which is fixed to the floating tube 7 at the middle thereof and a hollow cylindrical portion 24 which is fixed on the carrying carriage 22 as can be seen in FIGS. 2, 3 and 6 to 8.

The range of angles through which the ball joint 23, 24 allows the floating tube 7 to be pointed enables proper connection of a connector 8 or 9 on the floating tube with a complementary connector 6 or 10, and in particular makes it possible to put the meeting planes of the connectors parallel to each other during, and naturally, after locking.

The hollow portion 23 is located on the axis of a central retainer part 25 which is intended to be a vertical part, and is transversed horizontally by the tube in such a manner that the connectors 8 and 9 are situated on either side of the retainer part. The retainer part 25 is positioned in the carrying carriage 22 by means described below in such a manner that, as mentioned above, the tube 7 has its longitudinal axis parallel to the direction of displacement of the transfer carriage 7 on the rails 18A and 18B.

Figure 7:
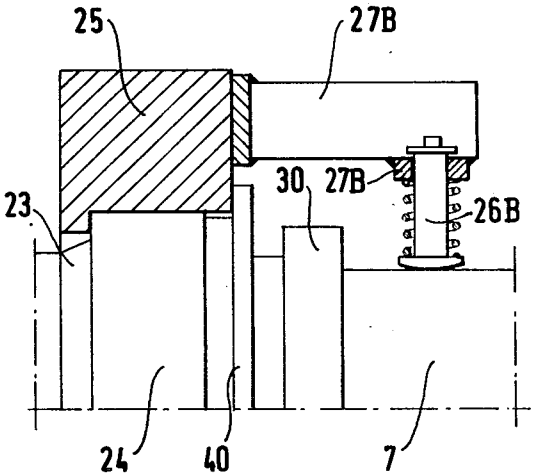
FIGS. 6, 7 and 8 are sectional views which show details of the ball joint carrying carriage included in the positioning device in accordance with the invention.
Figure 6:
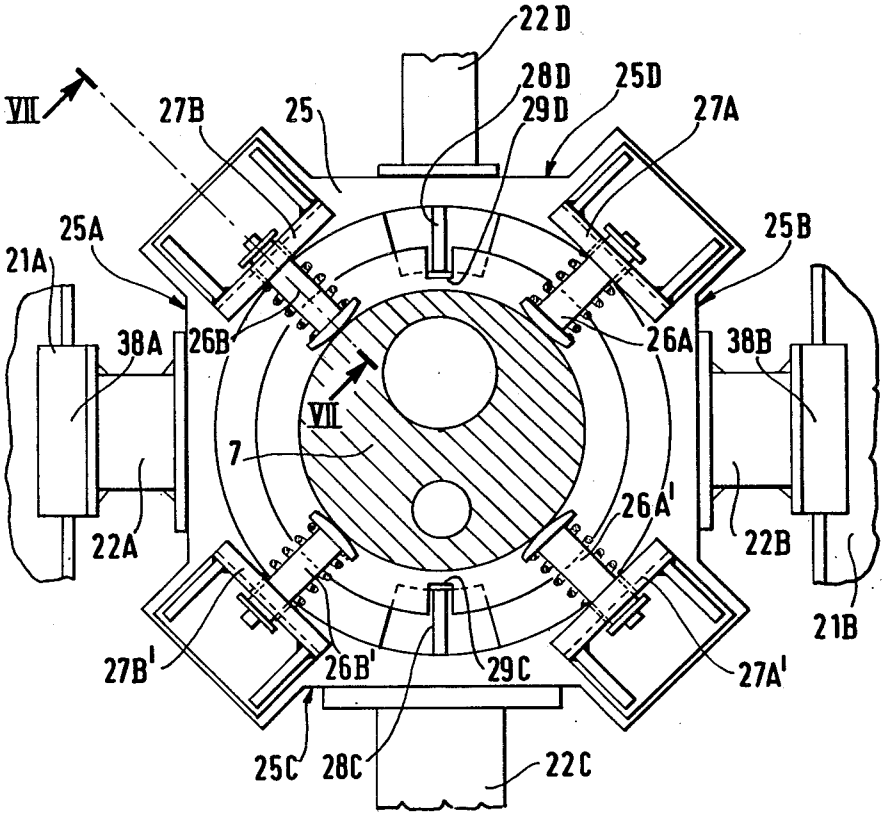
Figure 8:
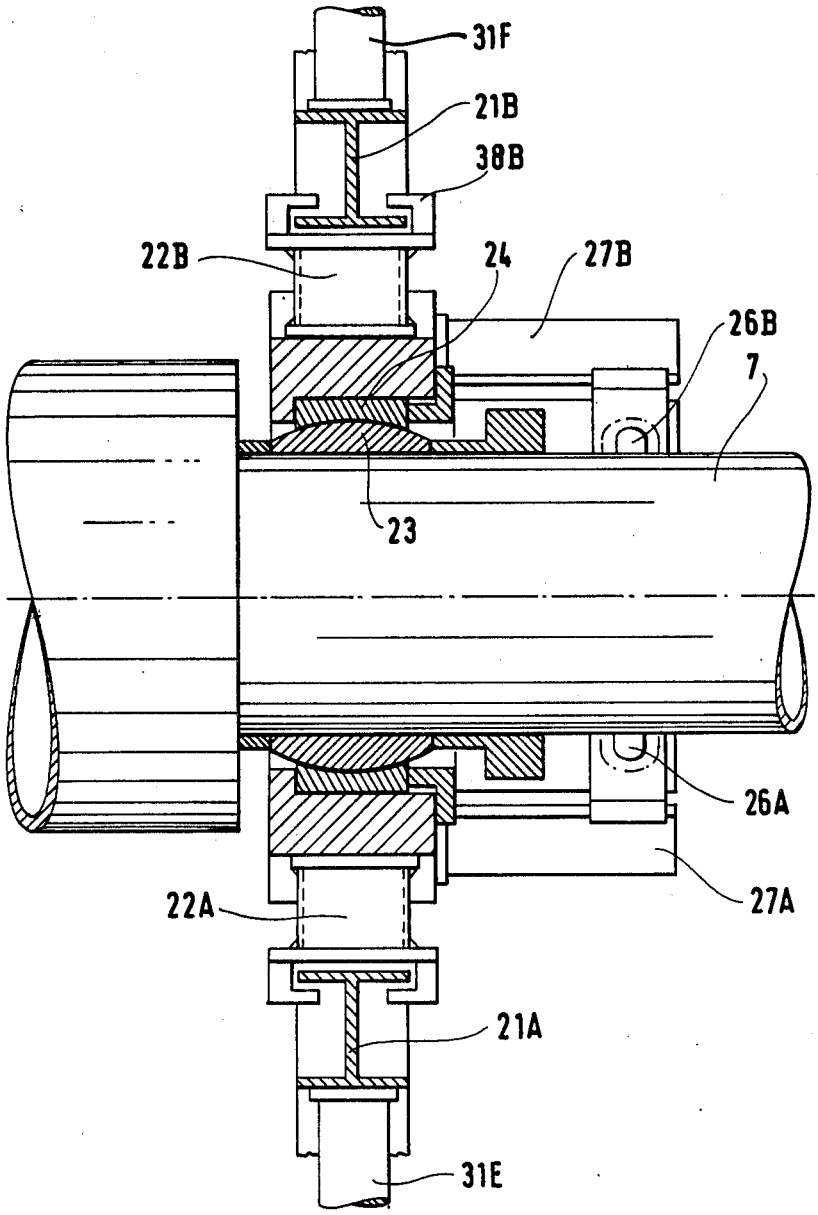

The retainer part 25 is disposed and held vertical by its carrying carriage and serves to keep the floating tube in the horizontal position via a set of resilient, preloaded and retractable pistons 26 placed at the ends of a corresponding number of equidistant arms 27 fixed to the retainer part 25 such that the pistons 26 which are disposed more or less perpendicularly to the normal horizontal axis of the tube press against the outside cylindrical surface of this tube in order to position it (FIGS. 6 and 7).

Pegs 28 disposed on either side of the floating sleeve 7 on the retainer part 25 serve to limit the angle through which the tube can rotate by cooperating with diametrical notches 29C and 29D (having a vertical axis in this case) which are provided in an annular ring 30 which is fixed on the tube at a small distance from the spherical portion 23.

The retainer part 25 has four bearing faces 25A, 25B, 25C and 25D which are parallel to its longitudinal axis and which are also offset from said axis, as can be seen in the cross-section through the retainer part shown in FIGS. 3 and 6.

Four positioning parts 22A, 22B, 22C and 22D of elongate shape constitute, together with the retainer part 25 placed at their center, the main components of the carrying carriage 22.

Two of these positioning parts 22A and 22B are fixed perpendicularly to the bearing faces 25A and 25B at one of their ends and provide guidance along an axis perpendicular to the plane of displacement of the transfer carriage 7 by means of slideway components (38A and 38B) disposed at their respective other ends.

The two positioning parts 22C and 22D are each constituted at a first end by two jacks 31C and 31D acting in opposite directions which are disposed perpendicularly to the plane of the transfer carriage 7 on the axis passing through the center of the ball joint 23, 24 and which thrust against the opposing bearing faces 25C and 25D of the retainer part 26 by bearing against the beams of the intermediate carriage 21. In a preferred embodiment, the jack 31C situated under the retainer part 25 is a double-acting hydraulic jack powered by a pressure accumulator (not shown) so as to exert an upwards vertical force which is greater than the underwater weight of the assembly comprising the floating tube 7 and its carrying carriage 22 fitted with the ball joint 23, 24 and which preloads the jack 31 in such a manner that this jack which is a spring-type jack exerts a balancing downwards pressure of the retainer part. Thus, after immersion, the retainer part 25 takes up a predetermined position.

The intermediate carriage 21 is designed in such a manner as to limit as much as possible the vertical extent of the positioning device for providing the desired vertical displacement of the carrying carriage 22 (FIG. 3).

To this end, the bottom part of the intermediate carriage 21 moves between and beneath the rails 18A and 18B of the frame.

Figure 4:
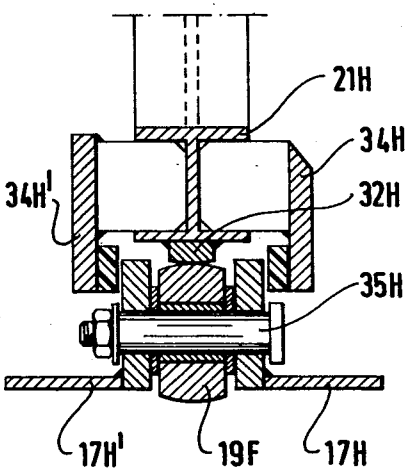
FIG. 4 is a sectional view which shows a detail of the transfer carriage-intermediate carriage assembly in accordance with the invention.

This bottom part of the intermediate carriage 21 is constituted by a bottom beam 21C arranged to be disposed transversely under the rails 18A and 18B when the intermediate carriage is in place. The middle of the bottom beam 21C supports the second end of the jack 31C and the beam is itself carried by two oblique beams 21E and 21F which serve to position it between the rails. Each of the oblique beams 21E and 21F is suspended under and at the end of a corresponding wheel beam 21G, 21H which moves parallel to the displacement plane of the transfer carriage 17 and transversely to the displacement axis of this carriage. The two wheel beams 21G and 21H have respective running bars 32G and 32H mounted on their respective flanges and running on wheels 19E and 19F carried by the transfer carriage 17, and more particularly by the L-shaped lengths of beam referenced 17G, 17G', and 17H, 17H', with the detail of one of the wheel beams being shown in FIG. 4. These links are disposed parallel to the plane of displacement of the transfer carriage 17 at equal distances from the transverse mid-plane of this carriage, and the axes of the wheels 19 are practically in the same plane.

The intermediate carriage 21 is prevented from derailing by four side plates 34 fixed on either side of the wheel beams 21G or 21H so as to enclose the parallel wheel-carrying flanges of the beam lengths 17G, 17G' and 17H, 17H'. For example, side plates 34H and 34H' are fixed on either side of the wheel beam 21H so as to move parallel to the beam lengths 17H and 17H'.

The intermediate carriage 21 also includes three beams which constitute guidance slideways 21A, 21B and 21D. The slideways 21A and 21B are fixed perpendicularly to the wheel beams 21G and 21H and above them in such a manner that the various beams 21 are coplanar and that the upper slideway 21D is parallel to the bottom beam 21C.

The slideways 21A and 21B are provided to cooperate with respective complementary slideways 38A and 38B mounted on respective ones of the positioning parts 22A and 22B, and to this end they are are I-section beams and the complementary slideway element engages one of the T-shaped flanges of said I-section so as to slide parallel to the longitudinal axis of the slideway.

The top slideway 21D is fixed perpendicularly to the ends of the slideways 21A and 21B and extends on either side of the slideways 21A and 21B such that its bottom flange bears on two complementary slideway members 39A and 39B fixed at the ends of two fixed support beams 17A and 17B which are perpendicular to the beam 17E and 17F of the transfer carriage 17 and which are above the carriage.

The bottom beam 21C and the top slideway 21D are each connected by their middles to the second ends of a respective one of the jacks 31C and 31D whose first ends 22C and 22D are applied against the retainer part 25.

Two opposing resilient and precharged spring jacks 31E and 31F are inserted between each of the support beams 17A and 17B and the nearest of the slideway beams 21A and and 21B in such a manner as to enable both-way transverse displacement of the intermediate carriage 21, of the carrying carriage 22, of the retainer part 25, and thus of the tube 7 relative to the direction of displacement of the carrying carriage 17 and from a median equilibrium position.

Consequently, more displacement of the transfer carriage 17 towards the sleeve 5 or towards the exploitation module 1 causes the internal channels of the floating tube to be aligned with the internal channels of the gatherer 4 or of the duct 1 by virtue of the connector 8 or 9 being self-centering on the axis of the associated connector 6 or 10 by virtue of the chamfered end such as 6A (FIG. 1) sliding over the conical wall of the flared inlet such as 8A and under the effect of the translation force exerted by the hydraulic jacks 31A and 31B. The reactions set up by a floating tube connector 8 or 9 bearing the complementary connector 6 or 10 which is at least temporarily fixed during connection, gives rise to modifications in the orientation of the tube 7 and/or to displacements of the retainer part 25 relative to the intermediate carriage 21 or to the transfer carriage 17, and relies on the resilience of the jacks 31C, 31D, 31E and 31F and of the pistons 26.

Figure 9:
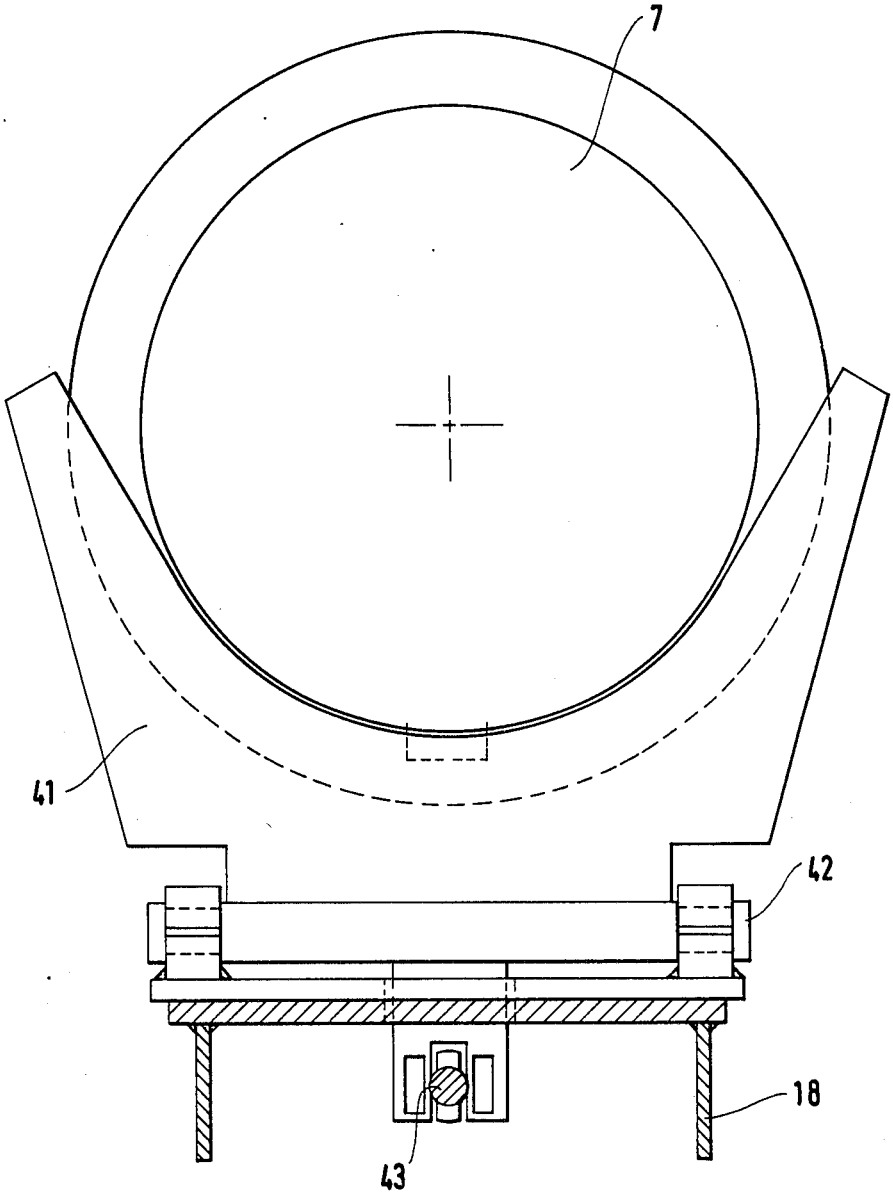
FIG. 9 is vertical sectional view which shows a detail of a support cradle included in the positioning device in accordance with the invention.

To ensure that the tube 7 is held vertically prior to connection, there is at least one and there are preferably two support cradles 41 and 41' (FIG. 9) at one and preferably at both ends of the frame 18 which carries the rails 18A and 18B and beyond these rails in the direction of the displacement axis of the transfer carriage 17.

These support cradles 41 and 41' are rotatably mounted on shafts 42 and 42' so as to be capable of passing from a position which is approximately vertical for supporting the floating tube 7 to a retracted position to enable displacements of the tube, the cradles being lowered in rotation by jacks 43 and 43' which are oscillatory jacks and which are remote-controlled.

We claim:

1. A floating tube apparatus having a floating tube (7) for sealed reversible and remote-controlled connection of ducts (4, 11), in particular underwater ducts, provided with connectors (6, 10) at their ends which are complementary to connectors (8, 9) carried at the ends of said floating tube (7) and which prior to connection have a position which is at least approximately determined in a range of admissible tolerances, in such a manner as to enable successive connection of one of the ducts (4) whose connector (6) is at least displaceable in a sealed manner upon being locked to the corresponding connector (8) of the floating tube (7) when displaced longitudinally under remote-control, and then of the other duct (11) upon locking of the connector (10) of said other duct to the corresponding connector (9) of the floating tube after longitudinal displacement in the opposite direction to the previous direction of the floating tube (7) and of at least the connector (6) of the first connected duct; the improvement comprising:

a positioning device (17, 21, 22, 23, 24) for positioning the floating tube (7), a fixed structure (18) defining a rectilinear rolling path (18A, 18B) along a reference plane on which the positioning device is displaceable, said positioning device comprising a ball joint (23, 24), three carriages (17, 21, 22) mounted on one another supporting said ball joint in such a manner as to enable each of said carriages to move rectilinearly along a displacement axis which is perpendicular to the displacement axes of the other two carriages, said carriages including a transfer carriage (17), at least one remote-controlled jack (31A) for moving said transfer carriage (17) on said rectilinear rolling path (18A, 18B) of the fixed frame, said three carriages including a carrying carriage (22) carried by the two other carriages and directly supporting the ball joint (23, 24), said floating tube (7) being hinged by said ball joint (23, 24) surrounding the middle portion of said tube (7) in such a manner as to enable proper connection of the tube connectors with the duct connectors by self-centering prior to locking and to continuously align the internal channels of the ducts by virtue of pointing the floating tube (7) in various directions at the ball joint and displacing the carrying carriage (22) relative to the fixed structure from a predetermined equilibrium position.

2. A floating connection tube apparatus according to claim 1, wherein said carriages include an intermediate carriage (21), means for supporting said intermediate carriage (21) for displacement horizontally along an axis which is perpendicular to the axis of horizontal displacement of the transfer carriage (17) which carries said intermediate carriage, and two opposing resilient jacks (31E, 31F) placed between the intermediate carriage (21) and the transfer carriage (17) and operatively connected to said intermediate carriage for displacing said intermediate carriage from an equilibrium median position.

3. A floating connecting tube apparatus according to claim 1 or 2, wherein said carrying carriage (22) includes a retaining part (25), and said said ball joint (23, 24) is placed in the middle of said retainer part (25) to enable the floating tube to be displaced in a vertical plane from an equilibrium position, and two jacks (31C, 31D) are operatively coupled to said retainer part (21) to predetermine the equilibrium position by opposing action therebetween, said two jacks (31C, 31D) including a bottom jack (31C) placed underneath the retainer part (25) to produce an upward vertical force which is greater than the weight of the assembly constituted by the floating tube, the ball joint and the retainer part, which it supports in such a manner as to prestress the opposing jack (31D) and to cause it to exert an equilibrium pressure directed downwardly.

4. A floating connection tube apparatus according to claim 3, wherein said central retainer part (25) of carriage (22) carrying the ball joint (23, 24) has operatively positioned relative thereto, four postioning parts (22A, 22B, 22C and 22D) whose coplanar axes are aligned in perpendicular pairs, and wherein two of said positioning parts (22A, 22B) are disposed in alignment on opposite sides of the retainer part (25) and include slideway members (38A, 38B), guide beams (21A, 21B) fixed to the intermediate carriage (21) and situated between the transfer carriage (17) and the carrying carriage (22) and engaging said slideway members (38A, 38B) to permit said slideway members (38A, 38B) to slide therealong, said other two postioning parts (22C, 22D) being likewise aligned on opposite sides of the retainer part (25) and mounted at the ends of opposing jacks (31C, 31D) connecting the retainer part (25) to the transfer carriage (21) for enabling the retainer part to move parallel to the gudie beams (21A, 21B), and wherein the axis of the hollow cylindrical portion (24) of the ball joint (23, 24) is perpendicular to the axes of the positioning parts (22A to 22D) at their point of intersection.

5. A floating connection tube apparatus according to claim 3, wherein said ball joint (23, 24) comprises a hollow cylindrical portion (24) and a spherical portion (22), the carriage (22) carrying the ball joint (23, 24) in its central retainer part (25) includes means for holding the floating tube (7) constituted by resilient pistons (26), said resilient pistons (26) being preloaded and retractable and being regularly disposed around the floating tube (7) and bearing against the floating tube (7), at a distance from the hollow cylindrical portion (24) of the ball joint (23, 24) which is fixed in the middle of the retainer part, with the pistons (26) being at least substantially perpendicular to the axis of the hollow cylindrical portion (24).

6. A floating connection tube apparatus according to claim 5, wherein the carriage carrying the ball joint (23, 24) in the central retainer part (25) includes means for limiting the angular displacement in rotation of the floating tube (7), said means comprising pegs (28) fixed to the retainer part in diameterically opposite positions relative to the axis of the hollow cylindrical portion (24) of the ball joint, and by corresponding notches in ring (29) mounted on the tube (7) beyond the spherical portion (23) of the ball joint.

7. A floating connection tube apparatus according to claim 1, wherein the transfer carriage (17) is a rectangular carriage which is hollow in the middle (17C, 17C', 17E, 17F), said intermediate frame (21) includes a bearing beam (21C) said hollow rectangular carriage enables limited interior dispalcement of said bearing beam (21C) during displacement thereof relative to the transfer carriage, and wherein the slideway members (39A, 39B) for the top bearing beam (21D) of the intermediate carriage are situated at the top of the support beams (17A, 17B) fixed to the transfer carriage (17) in such a manner as to enable the intermediate carriage (21) to be displaced transversely relative to the direction of displacement of the transfer carriage.

8. A floating connection tube apparatus according to claim 3, wherein the carriage (22) carrying the ball joint is placed in the middle of a plane intermediate carriage (21), between two parallel guide beams (21A, 21B) and two jack bearing beams (21C, 21D), said jack beams (21C, 21B) which are urged perpendicularly to the two parallel guide beams (21A, 21B) and wheren the jack bearing beams (21C, 21D) are disposed on either side of the running plane of the intermediate carriage (21) on the transfer carriage (17) in order to reduce the overall height of the positioning device.

9. A floating connection tube apparatus according to claim 8, wherein the plane intermediate carriage (21) includes two wheel beams (21G, 21H) aligned in parallel with the bearing beams (21C, 21D) between said bearing beams, and on either side of the guide beams (21A, 21B), for displacement along the alignment axis of the wheel beams (21G, 21H), said transfer carriage (27) includes wheels (19E, 19F) for effecting displacement of the two wheel beams (21G, 21H), one of said bearing beams (21D) constitute a top beam and are additionally guided by slideway members (39A, 39B) connected to said transfer carriage (17), and and said apparatus further comprises jacks (31E, 31F) for displacing the intermediate carriage (21) relative to the transfer carriage (17) being respectively situated between each guide beam (21A, 21B) and the support beam (17A, 17B) closest to the half-height of the intermediate carriage (21).

10. A floating connection tube apparatus according to claim 1 or 2, wherein said fixed structure includes at least one support cradle (41) supporting the floating tube (7) at the end of the running path (18A, 18B) of the transfer carriage (17), said cradle (41) being rotatably mounted on a shaft (42) in such a manner as to movable between a position which is at least approximately vertical for supporting the floating tube when parallel to the reference plane constituted by the rolling path (18A, 18B) and a retracted position permitting the floating tube to be displaced axially and to be oriented through an angle.

* * * * *